US006892964B2

(12) United States Patent
Grether et al.

(10) Patent No.: US 6,892,964 B2
(45) Date of Patent: May 17, 2005

(54) JET REGULATOR

(75) Inventors: Hermann Grether, Müllheim (DE); Christoph Weis, Lörrach (DE)

(73) Assignee: Dieter Wildfang GmbH, Mullheim (DE)

( * ) Notice: Subject to any disclaimer, the term of this patent is extended or adjusted under 35 U.S.C. 154(b) by 227 days.

(21) Appl. No.: 10/297,521

(22) PCT Filed: May 18, 2001

(86) PCT No.: PCT/EP01/05725

§ 371 (c)(1),
(2), (4) Date: Dec. 5, 2002

(87) PCT Pub. No.: WO01/94707

PCT Pub. Date: Dec. 13, 2001

(65) Prior Publication Data

US 2004/0050968 A1 Mar. 18, 2004

(30) Foreign Application Priority Data

Jun. 6, 2000 (DE) ..... 100 27 987

(51) Int. Cl.[7] ..... E03C 1/08

(52) U.S. Cl. ..... 239/428.5; 239/553.5; 239/575; 239/590.5

(58) Field of Search ..... 239/419.5, 428.5, 239/553, 553.3, 553.5, 575, 590, 590.3, 590.5, DIG. 23; 138/37, 41, 42, 44

(56) References Cited

U.S. PATENT DOCUMENTS

| | | | | |
|---|---|---|---|---|
| 2,717,614 A | * | 9/1955 | Palivos | 138/37 |
| 3,130,915 A | | 4/1964 | Aghnides | |
| 3,173,614 A | * | 3/1965 | Aghnides | 239/428.5 |
| 3,633,824 A | * | 1/1972 | Aghnides | 239/428.5 |
| 3,811,619 A | * | 5/1974 | Aghnides | 239/428.5 |
| 4,119,276 A | | 10/1978 | Nelson | |
| 4,153,204 A | * | 5/1979 | Aghnides | 239/428.5 |
| 4,294,289 A | | 10/1981 | Fischer | |
| 4,637,552 A | * | 1/1987 | Finkbeiner et al. | 239/428.5 |
| 5,495,985 A | * | 3/1996 | Nehm et al. | 239/428.5 |
| 6,126,093 A | * | 10/2000 | Grether et al. | 239/428.5 |
| 6,152,182 A | | 11/2000 | Grether et al. | |

FOREIGN PATENT DOCUMENTS

| | | | |
|---|---|---|---|
| DE | 19642055 | | 4/1998 |
| WO | WO 9816695 A1 | * | 4/1998 |

* cited by examiner

*Primary Examiner*—Steven J. Ganey
(74) *Attorney, Agent, or Firm*—Volpe and Koenig, P.C.

(57) ABSTRACT

The invention relates to a jet regulator (1), comprising a jet regulator housing (2), within the interior of which a jet regulation device (4) is provided. According to the invention, such a jet regulator (1) can be produced at low cost, by means of simple conventional production techniques with simultaneous anti-scaling effect on the jet regulation device (4), whereby the jet regulation device (4) comprises several insertable components (9, 10), which may be inserted in series in the jet regulator housing (2) in the direction of flow (Pf1). The insertable components (9, 10) comprise passage openings (11), which are unidirectionally defined and extend across the cross-section of the passage, and the passage openings (11) of adjacent insertable components (9, 10) are arranged offset to each other in the circumferential direction of the jet regulator housing (2), or in the direction of flow (Pf1) of the jet regulator (1).

24 Claims, 5 Drawing Sheets

JET REGULATOR

BACKGROUND

This invention pertains to a jet regulator with a jet regulator housing in whose interior a jet regulation device is provided that has passage openings running approximately across the passageway cross section, the openings being offset with respect to one another in the circumferential direction about the jet regulator housing or in the direction of flow of the jet regulator, wherein the jet regulation device has at least one insertable component containing the passage openings.

There is a prior art jet regulator containing at least one metal sieve on the outlet side, wherein a number of perforated plates are installed ahead of this metal sieve solely to reduce the flow (see U.S. Pat. No. 4,119,276). Metal sieves of this type, such as those provided in U.S. Pat. No. 4,119,276 among others, tend to scale up, however.

A prior art jet regulator is known from DE 196 42 055 C2, which is used in the outlet mouthpiece of a sanitary outlet valve to produce a soft bubbling and non-splashing water jet. The prior art jet regulator has a perforated plate that divides the incoming water jet into a number of individual jets which are then recombined into a homogeneous overall jet in a jet regulation device, if necessary after mixing with air.

In this case, the shell-like jet regulator housing of the prior art jet regulator is made up of at least two shell sections designed as peripheral segments. The jet regulating device has pins that run perpendicular to the direction of flow which project on the inside of at least one of the peripheral segments that are manufactured as plastic injection molded parts.

In DE-U-297 18 728 a prior art jet regulator is described as having a jet regulator housing in whose interior a jet regulation device is provided. The jet regulation device has passage openings extending across the cross section of the flow, with the openings being offset with respect to one another in the circumferential direction about the jet regulator housing or in the direction of flow of the jet regulator. Thereby, the jet regulation device of the prior art jet regulator has an insertable component that contains the passage openings, said component consisting of at least two shell parts forming cylinder sectors. These shell parts can be assembled into a cylindrical shell. Pin sections are provided in each of these shell parts that form pairs of impingers that are aligned with one another when the shell parts are assembled.

The design of the prior art insertable component according to DE-U297 18 728, which contains shell parts and forms cylinder sectors, also limits the design possibilities, and thus also the areas of application of the prior art jet regulator, as well as requiring expensive injection-molding tools.

Therefore, the objective arises of creating a jet regulator of the type mentioned above that can be manufactured with little effort using simple common manufacturing techniques, with the jet regulation device thereof not tending to scale up.

The solution to this objective according to the invention with regard to the jet regulator of the type mentioned above is provided in particular in that a number of insertable components are provided that can be inserted one after the other in the direction of flow into the jet regulator housing, that the insertable components have a peripheral external support ring and ribs are connected to it on the inside and extend from one end to the other across the flow cross section, and that the approximately parallel ribs of the insertable components that are separated from one another define unidirectionally oriented passage openings.

The jet regulator according to the invention has a jet regulation device that is made up of essentially a number of insertable components that can be inserted into the jet regulator housing in the direction of flow one after another. Each of these insertable components has a number of unidirectional passage openings that run approximately across the passageway cross section. The passage openings of adjacent insertable components are arranged offset with respect to one another either in a circumferential direction about the jet regulator housing or in the direction of flow of the jet regulator.

If the passage openings are arranged offset with respect to one another in the circumferential direction, the adjacent insertable components form a mesh structure without requiring a conventional metal sieve, which can lead to undesired scaling of the jet regulator. If on the other hand, the passage openings are arranged offset with respect to one another in the direction of flow, the passage openings of the adjacent insertable components, which are oriented approximately in the same direction, form a cascade-like structure. Even though complex meshed or cascade-like structures, which can dramatically slow down the flow velocity and form a soft bubbling water jet, can be created with the help of the insertable components provided according to the invention, each insertable component is in and of itself of a comparatively simple design and can be produced with little effort using simple conventional manufacturing techniques.

In this way, an especially simple and preferred embodiment of the invention provides that the insertable components are located offset with respect to one another rotationally to form a mesh structure.

In order to prevent the ribs that define the passage openings from bending, it is advantageous if the insertable components have at least one support rib that extends perpendicular to the ribs that run approximately parallel, in particular that is diametric, said support rib being preferably connected to the ribs.

In order to be able to position the passage openings of the adjacent insertable components as much perpendicular with respect to one another as possible into a mesh structure, or as unidirectionally as possible into a cascade-like structure, a further development of the invention that should also be protectable provides that positioning projections and recesses are provided on the jet regulator housing on the one hand and on the insertable components on the other hand in order to install the insertable components in the correct positions, and that to this end projections are provided preferably on the exterior of the insertable components and notched insertion guides are provided on the interior of the housing that are open toward the inlet side.

In this way, the correct sequence of the individual insertable components, which can also be designed uniquely, is ensured when the jet regulator according to the invention is assembled, provided that the positioning projections and recesses provided at the jet regulator housing and on the insertable components are designed differently and are fitted to effect the correct positioning of each insertable component accordingly.

So that the individual jets fed to the jet regulation device of the jet regulator according to the invention can be reshaped therein into a homogeneous overall jet, it helps if the width of the ribs of the insertable components is less than their height in the direction of flow. The water jet is well directed and evenly distributed between the ribs, which are higher than they are wide.

The insertable components of the jet regulator according to the invention can be manufactured in an especially simple manner as injection molded parts. So that the overfill that remains in the plane of separation of the injection molding tool does not result in any undesired noise buildup, it is advantageous if the ribs of the insertable components have a section at the inlet side with a larger cross section and an adjacent section at the discharge side with a comparatively smaller cross section. In this way, the plane of separation between the two halves of the mold of the injection molding tool can be located precisely in the plane of separation between the section of the ribs at the inlet side and the section at the discharge side.

The individual jets are divided especially well and noiselessly in the jet regulation device of the jet regulator according to the invention if the inlet section of the ribs at the inlet side of the first insertable component is designed similar to a saddle roof, and if a round section at the discharge side follows this directly via a quick return of the cross section, preferably with an approximately rectangular cross section.

An elevated braking effect can be imposed on the water stream without having to fear an undesired backup if the inlet section of the ribs of an insertable component that is placed after the first insertable component at the inlet side has a rounded side facing the inlet, and if a round section at the discharge side follows this directly, preferably via a quick return of the cross section, preferably with an approximately rectangular cross section.

The ribs of the adjacent insertable components can be held at a minimal distance from one another as necessary without a problem if the height of the support ring of the insertable component oriented in the direction of flow is larger than the height of the ribs and of the support rib, if present, and if the ribs and the support rib are located within the peripheral contour of the support ring.

It is especially advantageous if at least two insertable components are provided one after the other in the direction of flow, preferably directly adjacent to one another.

In order to be able to divide the water stream that flows to the jet regulator according to the invention into individual jets, a preferred embodiment of the invention provides that a jet splitting device is installed before the jet regulation device that has at least one perforated plate that can be latched removably to the jet regulator housing.

The individual components of the jet regulator according to the invention are held securely and fast in their position if the perforated plate pushes against an insertable component at its discharge side and if, to this end, the perforated plate has at its discharge side guide stems that extend preferably up to the first insertable component and push against it.

Good jet formation in the jet regulator according to the invention is facilitated even more if a flow rectifier is installed after the jet regulation device at the discharge side, said rectifier having circular segmented or honeycomb shaped outlet openings whose opening widths are smaller than their height in the direction of flow.

In order to secure the jet regulator according to the invention against willful destruction of the insertable components located in the interior of the jet regulator housing and to be able to simultaneously use the flow rectifier as a vandalism security device, it is advantageous if the flow rectifier is connected in one piece to the jet regulator housing and is located at its discharge end.

The insertable components of the jet regulator according to the invention can be manufactured in a simple manner using simple conventional manufacturing methods. Thus, a further development according to the invention provides that the insertable components are manufactured with a support ring, ribs and if necessary support rib and projections as a one-piece metal part via forging or cold forming. Such insertable components designed as metal parts exhibit excellent mechanical stability and temperature resistance in comparison to plastic parts. Moreover, insertable components made of stainless steel, for example, can be recommended for areas of used where high hygienic requirements exist.

Metallic insertable parts can also be manufactured in small numbers especially economically if the insertable components are manufactured from a metal sheet using a stamping and/or shaping process. Insertable components that are manufactured from a metal sheet via a stamping and/or shaping process and therefore allow a high profitability.

In order to be able to slow down effectively the individual jets issuing from a perforated plate or similar jet splitting device it can be helpful if at least one of the insertable components that is designed as a stamped and/or shaped part has ribs that have an external contour that widens in the flow direction. The ribs can have a curved or roof-shaped external contour. Curved ribs can be designed for example circular arc shaped or elliptical.

In order to be able to successively slow down the speed of the individual jets from insertable component to insertable component, it can be helpful if the tilt angle of the rib profile of the curved or roof-shaped ribs provided on the insertable components in the direction of flow successively decreases. This allows the ribs provided on the upper insertable component or the upper insertable components to have a steeper angle in the tilt of their rib profile in comparison to the ribs on the subsequent insertable components.

It is advantageous if the metal sheet is made of brass or preferably stainless steel. Thereby, the projections on the support ring of the insertable components provided to position the insertable components can be formed out of an un-deformed section of the metal sheet.

According to another aspect of the invention, the insertable components are designed with a support ring, ribs and if necessary a support rib and projections in one piece as an injection molded part, in particular as a plastic injection molded part.

BRIEF DESCRIPTION OF THE DRAWINGS

Other features of the invention can be found in the following description of an exemplary embodiment of the invention in connection with the claims as well as the drawing. The individual features can be implemented in and of themselves or together to form an embodiment according to the invention.

Shown are.

DETAILED DESCRIPTION OF THE PREFERRED EMBODIMENTS

Figure 2:
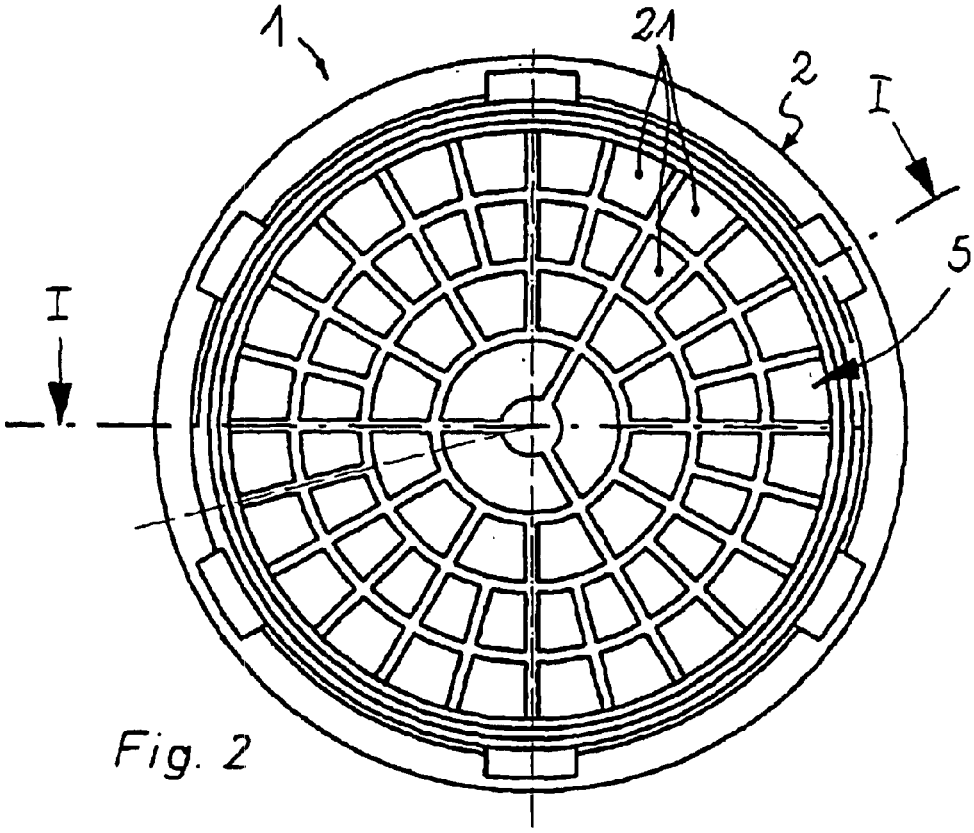
FIG. 2 is a plan view of the jet regulator from FIG. 1 showing the discharge side.
Figure 1:
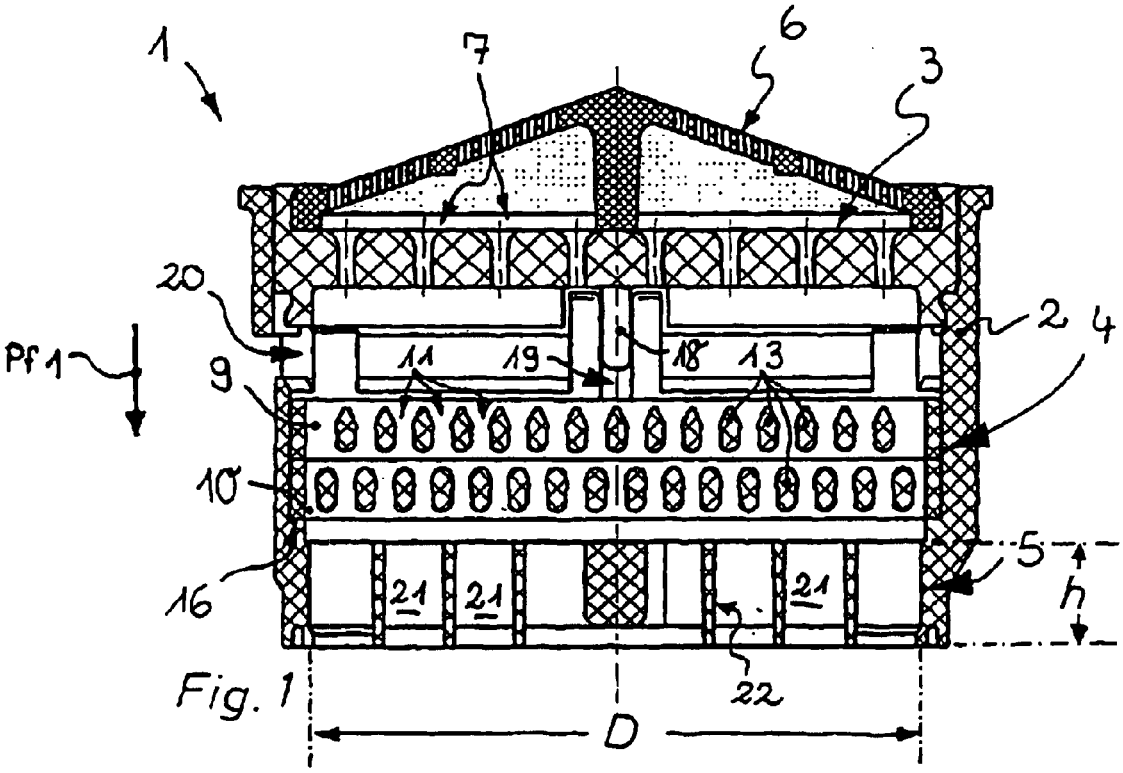
FIG. 1 is a longitudinal view of a jet regulator having a jet regulation device made of a number of insertable components that can be inserted into the jet regulator housing.

In FIG. 1, a jet regulator is shown that can be used to produce a homogeneous soft bubbling and non-splashing water jet to the outlet mouthpiece of a sanitary outlet valve, which is not shown here further.

The jet regulator 1 has a shell-like jet regulator housing 2 in whose interior a jet regulation device is provided in the form of a perforated plate 3 perforated in the direction of flow Pf1, followed by a jet regulation device 4 and at the discharge side a flow rectifier 5. In order to keep dirt particles out of the interior of the housing of the jet regulator 1 and in order to be able to ensure its free flowing operation, an intake filter 6 is placed upstream of the jet regulator 1 in the flow direction.

Figure 3A:
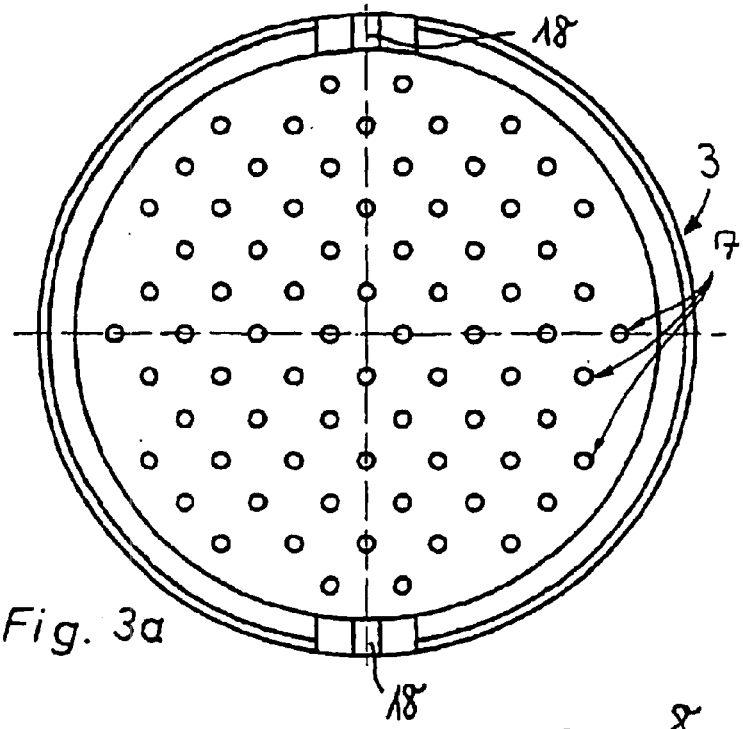
FIGS. 3*a*–3*c* are views of the jet regulation device designed as a perforated plate, wherein this perforated plate is shown in plan views from the discharge side and from the inlet side (FIGS. 3*a* and 3*c*) and in a longitudinal section (FIG. 3*b*)
Figure 3B:
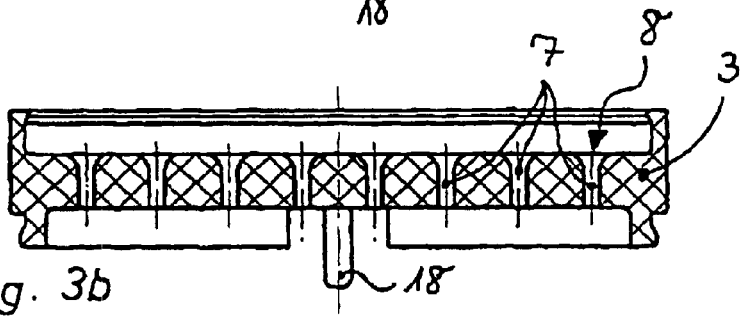
Figure 3C:
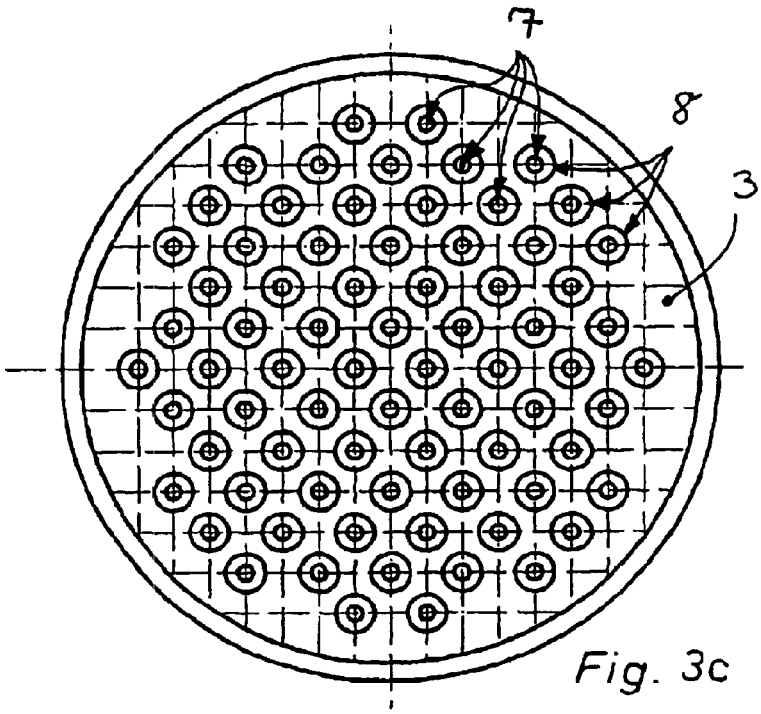

The perforated plate 3, the plane of which is oriented perpendicular to the direction of flow Pf1, has a number of flow-through holes 7 separated from one another, each of which has at the inlet side a conical round inlet opening 8 (see FIGS. 3*b*, 3*c*).

The fluid stream that flows into the jet regulator 1 is divided into a number of individual jets in the jet splitting device, which is designed as a perforated plate 3. These individual jets are then formed into a homogeneous and soft bubbling overall jet in the jet regulation device 4 that follows.

The jet regulation device 4 has in addition to this two insertable components 9, 10 directly adjacent to one another, each of which has unidirectional passage openings 11 that extend across the cross section of the passageway. The passage openings 11 of the two adjacent insertable components 9, 10 are offset with respect to one another in the direction of flow Pf1, thus forming a cascade-like structure.

It would also be possible to arrange the insertable components 9, 10 offset with respect to one another in the circumferential direction such that instead a mesh structure results. In this way, the passage openings 11 of each insertable component 9, 10 are unidirectional, i.e. they run parallel to one another,—but taken together the two insertable components 9, 10 form a sieve or grating structure. By means of this sieve or grating or—as in this case—cascade-like structure, the water jet is slowed down to be able to exit as a soft bubbling overall jet.

Figure 4A:
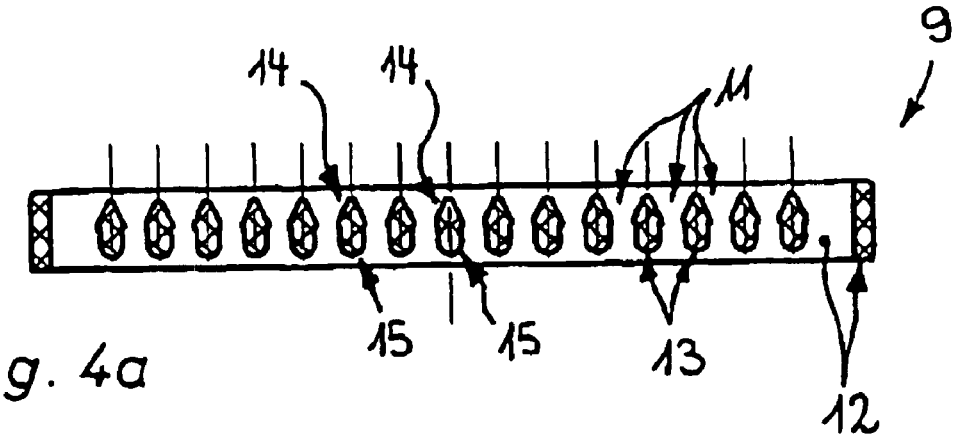
FIGS. 4*a* and 4*b* are views of the insertable component of the jet regulation device of the jet regulator from FIGS. 1 and 2 after the perforated plate, wherein this insertable component is shown in a longitudinal section (FIG. 4*a*) and in a plan view (FIG. 4*b*)
Figure 5A:
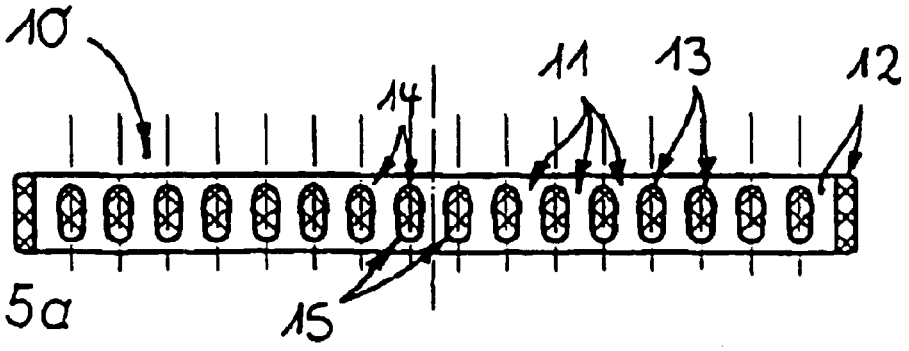
FIGS. 5*a* and 5*b* are views of the next insertable component of the jet regulator of FIGS. 1 and 2, also shown in a longitudinal section (FIG. 5*a*) and in a plan view (FIG. 5*b*)

The insertable components 9, 10 each have an external support ring 12 and ribs 13 that are connected to its interior, running approximately parallel and at a distance from one another, between which slotted passage openings 11 are formed. As can be seen in a comparison of FIGS. 1, 4*a* and 5*a*, the section 14 of the ribs 13 at the inlet side has a larger cross section and section 15 at the discharge side after it has a smaller cross section in comparison. Thereby, the plane that separates the inlet side and the outlet side of the ribs 13 of the insertable components 9, 10, which are designed as plastic injection molded parts, at the same time constitutes the plane of separation of the injection molding tool used. This eliminates excess injection molding flashing from occurring at the inlet side injection mold that could otherwise result in undesired, noise-generating turbulence.

Figure 4B:
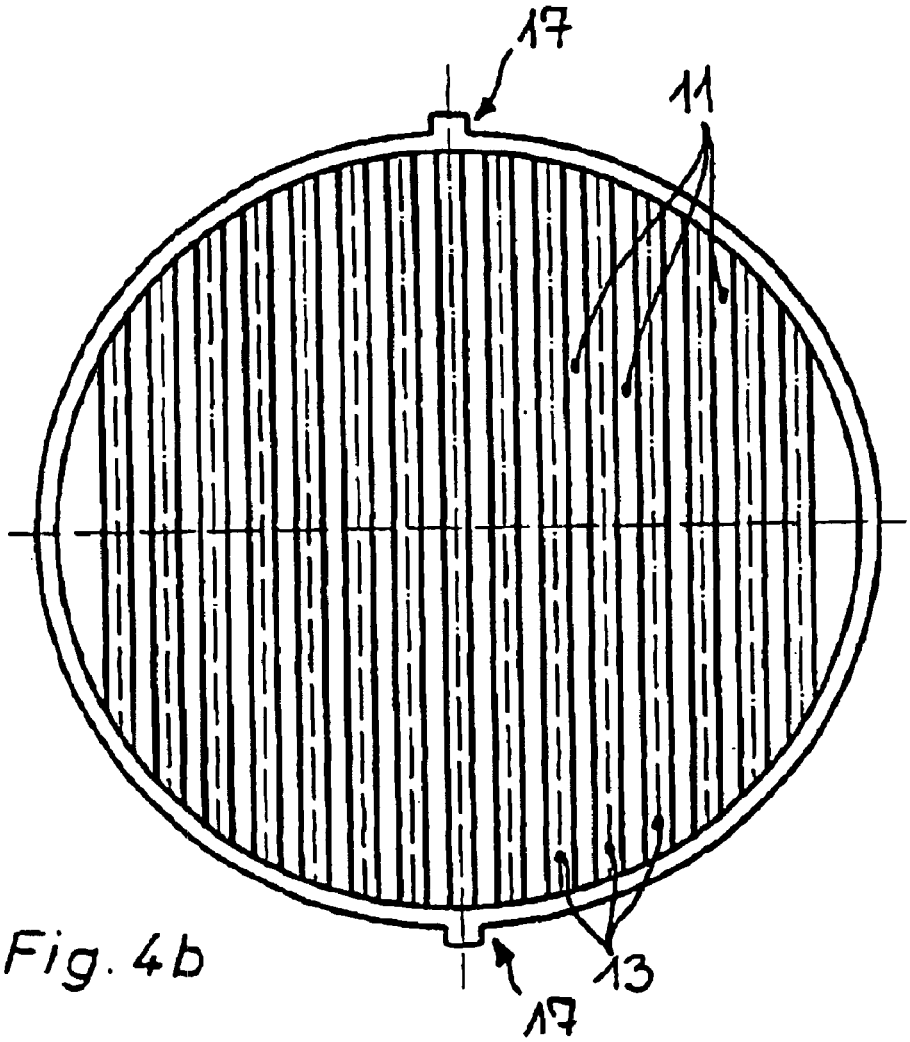

The section 14 of the ribs at the inlet side of the first insertable component 9 shown in FIG. 4 in more detail is designed similar to a gable roof. Section 15 at the discharge side follows this directly via a quick return of the cross section, and has an approximately rectangular cross section and is rounded at the discharge side. As shown in FIG. 4*b*. a support rib 25 can be provided that is diametric and extends perpendicular to the ribs 13. As can be seen in FIG. 1, the flow-through holes 7 are placed in the perforated plate 3 so that their centerlines are approximately axially aligned with the centerline of a rib 13 located after it at the discharge side.

Figure 5B:
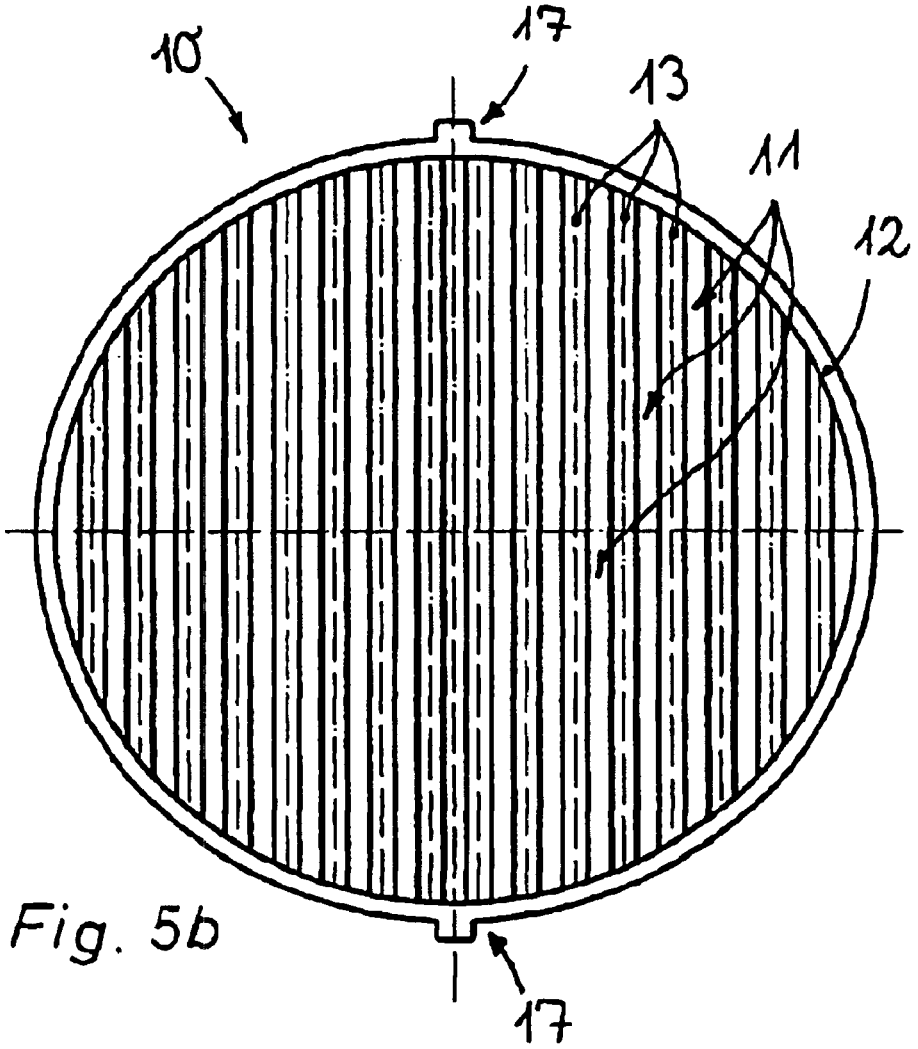

In FIG. 5, the insertable component 10 that is placed after the first insertable component 9 inserted from the inlet side is shown in more detail. The ribs 13 of this insertable component 10 have a section 14 at the inlet side that has a rounded inlet side. Section 15 at the discharge side follows this directly via a quick return of the cross section, and has an approximately rectangular cross section and is also rounded at the discharge side. The position of this next set of ribs increases the resistance to the flow of water without resulting in an undesired backup.

As can be seen in FIG. 1, the insertable components can be inserted removably into the jet regulator housing 2 at the inlet side of the housing together as far as an insertion backstop 16. To this end, the external perimeter of the support ring 12 of the insertable components 9, 10 is made to fit the unobstructed inner diameter of the jet regulator housing 2. After inserting the insertable components 9, 10 into the jet regulator housing 2, the perforated plate 3 is then inserted into the jet regulator housing 2 and removably attached there.

In order to secure the correct positional arrangement of the insertable components 9, 10 with respect to one another and the perforated plate 3, positioning projections and recesses are provided on the jet regulator housing 2 on the one hand and on the insertable components 9, 10 or perforated plate 3 on the other hand. To this end, the insertable components 9, 10 and the perforated plate 3 have guide projections 17 and 18 that fit notched insertion guides 19 in the inner diameter of the housing that are open in the direction of the inlet.

Whereas the guide projections 17 on the insertable components 9, 10 project radially outward and are located on opposite sides, the guide projections 18 provided on the perforated plate 3 project in the direction of flow Pf1. The guide projections 18 provided at the perforated plate 3 can if necessary be dimensioned long enough that the perforated plate 3 pushes against the insertable component 9 that follows it by means of these guide projections 18 and additionally secures it in place.

It can also be seen from FIGS. 1, 4, and 5, that the height of the support ring 12 of the insertable components 9, 10 oriented in the direction of flow Pf1 is larger than the height of the ribs 11 and that the ribs 11 remain within the peripheral contour of the support ring 12 so that the flow envelops the ribs 11 from all sides.

In order to evenly distribute the individual jets that are again divided into a soft bubbling overall jet in the jet regulation device 4, a flow rectifier 5 is installed after the jet regulation device 4 at the discharge side, with the rectifier having honeycomb-shaped or—as here—circularly segmented outlet openings 21.

The width of these outlet openings 21 is smaller than their height measured in the direction of flow Pf1. Since the flow rectifierer 5 is connected in one piece to the jet regulator housing 2 and is located at its discharge end, this flow rectifier 5 also serves simultaneously as a safety against vandalism.

The jet regulator 1 can be designed as a ventilated or unventilated jet regulator. The sanitary component, which in this case is designed as a ventilated jet regulator, has ventilation openings 20 at the peripheral cover of its jet regulator housing, with the openings feeding into the area between the perforated plate 3 and the jet regulation device 4.

It can be seen from FIG. 1 that the through holes 21 of the flow rectifier 5 are separated by guide walls 22 that extend approximately in the direction of flow Pf1. These guide walls 22 have a wall thickness that is a fraction of the unobstructed hole diameter of a through hole 21 that is surrounded by the guide walls 22. In order to facilitate the good functioning of the flow rectifier 5, it has been shown to be advantageous if the ratio h:D between the height h of the guide walls 22 and the overall diameter D of the flow straightener 5 is less than 1 and in particular less than 1:2.

In FIG. 6, an insertable component 23 is shown in various views and corresponds in its functioning to insertable components 9, 10 in FIGS. 4 and 5. However, whereas the insertable components 9, 10 shown in FIGS. 4 and 5 are designed as plastic injection molded parts, the insertable component 23 according to FIG. 6 is manufactured in one piece from a metal sheet in a stamping and shaping process. Insertable component 23 according to FIG. 6 also has ribs 13 that lie alongside the passage openings 11 running approximately across the passageway cross section and oriented unidirectionally. The ribs 13 are held in an external support ring 12 and can be inserted with it into a jet regulator housing. Located at the support ring 12 are guide projections 17 that are formed from an undeformed section of the metal sheet and that serve as positioning projections.

Figure 6C:
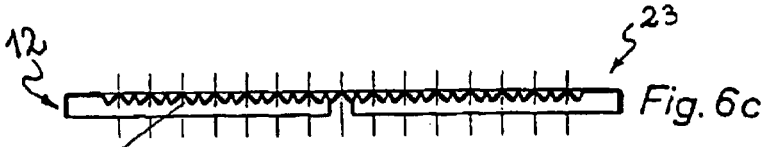
FIGS. 6*a*–6*e* are views of an insertable component manufactured from a metal sheet via a stamping and shaping process in a plan view of the inlet end (FIG. 6*a*) as well as in a longitudinal section (FIG. 6*b*) and a cross section (FIG. 6*c*), wherein an enlarged detail view of the inlet end and the cross section is shown in FIGS. 6*d* and 6*e*, respectively.
Figure 6E:
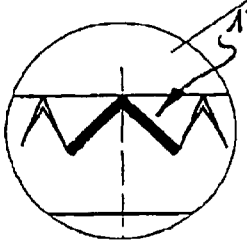
Figure 6A:
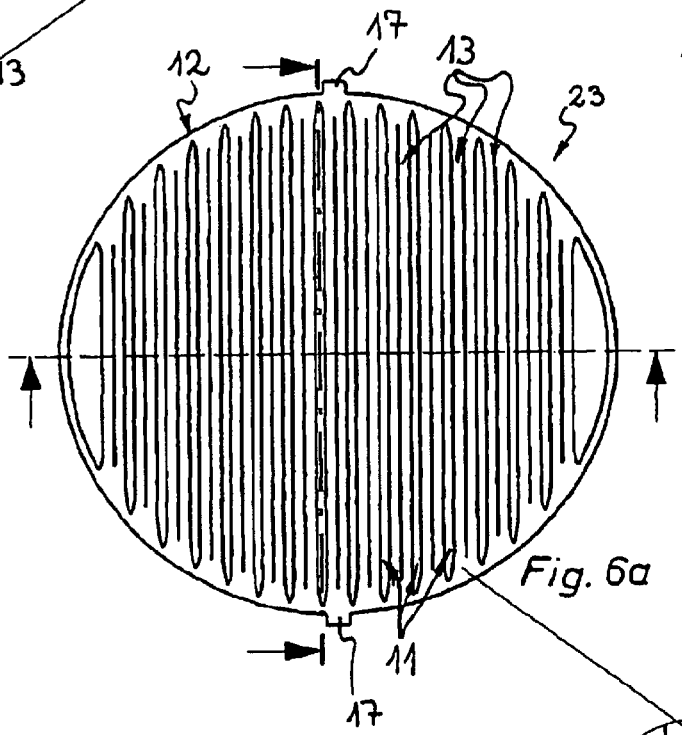
Figure 6B:
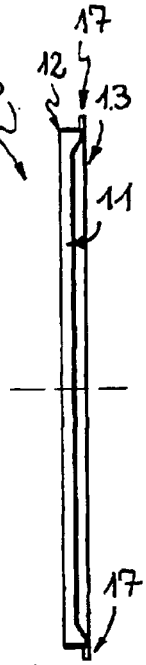
Figure 6D:
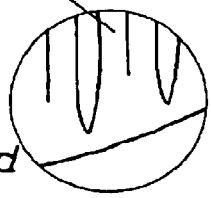

As can be seen from FIG. 6*c* and the detail representation in FIG. 6*e*, the profile of the unidirectional ribs 13 is roof-shaped.

The sheet thickness of the metal sheet used to manufacture the insertable component 23 is in accordance with the requirements of strength and formability of the material. Suitable materials include brass or preferably stainless steel. A brass sheet can subsequently be surface treated in order to ensure an improved corrosion protection.

The height of ribs 13 depends for one thing on the intervening material that is left over between the adjacent ribs 13 in the un-deformed condition of the flat metal sheet as maximum rib height, but can also be reduced if strips of material are stamped out of the flat metal sheet before the shaping process is performed to create the rib profile.

The insertable component 23 manufactured from a metal sheet exhibits relatively low manufacturing costs and higher mechanical stability and temperature resistance. Moreover, the use of an insertable component 23 made of a stainless steel can be recommenced for those areas of application where especially high hygienic requirements exist.

The height of the peripheral support ring 12, which is likewise manufactured by shaping from the flat metal sheet, is larger or the same as the rib height. The height of the support ring 12 determines the axial separation between two adjacent insertable components 23, wherein it can prove to be advantageous to configure the axial separations according to the side angle of the rib profile.

The number of unidirectional ribs 13 is dependent on the requirements of water jet braking and can be varied. A positioning of the insertion point of the metallic insertable component 23 required is accomplished by means of the projection 17 that is produced by not forming the flat metal sheet in this area into a peripheral circular arc.

Figure 7:
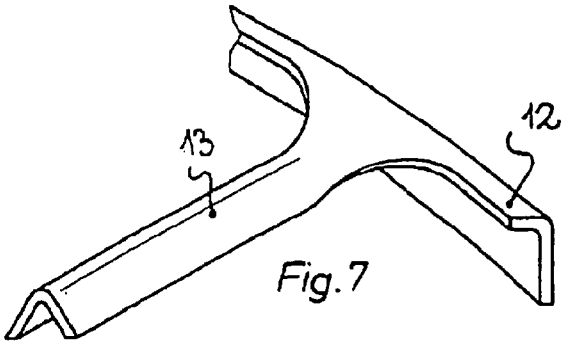
FIG. 7 is a partial view of a metallic insertable component in the area of a rib that is bent into a roof shape.
Figure 8:
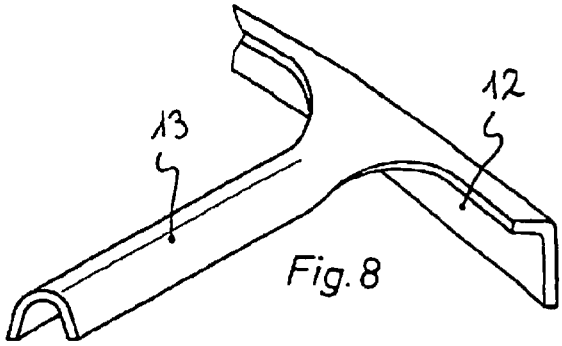
FIG. 8 is a partial view of a metallic insertable component in the area of a rib that is bent into a circular arc shape.

Comparing FIGS. 7 and 8 makes it clear that the profiling of the unidirectional ribs 13 can be selected both roof-shaped as well as curved. In this way, the angle of the rib profile can be designed differently, depending on how dramatically the water jet that arrives from above is to be slowed down. If the velocity of the individual jets coming from the jet splitting device is to be slowed down successively from insertable component to insertable component, it is also possible to provide the rib profile of the ribs 13 provided at an upper insertable component 23 with a steeper angle in comparison with the ribs 13 of an insertable component 23 placed after it at the discharge side.

As the examples in FIGS. 4 through 8 show, the jet regulator 1 shown here can also be manufactured with little effort using simple, conventional manufacturing techniques, wherein its jet regulation device 4 and its flow rectifier 5 do not tend to scale up.

What is claimed is:

1. A jet regulator (1) comprising a jet regulator housing (2) having an interior in which a jet regulation device (4) is provided that has passage openings (11) that extend approximately across a passageway cross section of the housing, said openings being offset with respect to one another in a circumferential direction about the jet regulator housing (2) or in a direction of flow (Pf1) of the jet regulator (1), wherein the jet regulation device (4) has at least one insertable component (9, 10, 23) containing the passage openings (11), and wherein the at least one insertable component comprises a number of insertable components (9, 10, 23) that can be inserted one after another in the direction of flow (Pf1) into the jet regulator housing (2), the insertable components (9, 10, 23) have a peripheral external support ring (12) and ribs (13) that are connected to the support ring on an inside thereof and that extend from one end to another across a flow cross section of the components, and the ribs (13) of the insertable components (9, 10, 23) are approximately parallel so that the passage openings (11) are unidirectionally oriented.

2. A jet regulator according to claim 1, wherein the insertable components (9, 10, 23) are arranged offset with respect to one another in the circumferential direction to form a mesh structure.

3. A jet regulator according to claim 1, wherein the insertable components (9, 10, 23) have at least one support rib that extends perpendicular to the ribs (13) that extend approximately parallel, that is diametric, said support rib being connected to the ribs (13).

4. A jet regulator according to claim 1, wherein in order to allow installation of the insertable components (9, 10, 23) in correct positions, end projections (17) are provided on an exterior of the insertable components (9, 10, 23) and notched insertion guides (19) are provided on an interior of the jet regulator housing (2) that are open toward an inlet side thereof.

5. A jet regulator according to claim 4, wherein the positioning projections and recesses provided on the jet regulator housing (2) and on the insertable components (9, 10, 23) are designed differently and are fitted to effect a correct positioning of each of the insertable component (9, 10, 23) accordingly.

6. A jet regulator according to claim 3, wherein the insertable components (9, 10, 23) are formed as one piece as an injection molded part with the support ring (12) and ribs (13) as well as a support rib, and with end projections (17) on the insertable components.

7. A jet regulator according to claim 1, wherein a width of the ribs (13) of the insertable components (9, 10) is less than a height thereof in the flow direction (Pf1).

8. A jet regulator according to claim 1, wherein the ribs (13) of the insertable components (9, 10, 23) have a section (14) at the inlet side with a larger cross section and an adjacent section (15) at the discharge side with a smaller cross section comparatively.

9. A jet regulator according to claim 8, wherein the section (14) of the ribs (13) at an inlet side of the first insertable component (9) has a gable roof shape, and a rounded section (15) at the discharge side directly follows the inlet side via a return of the cross section.

10. A jet regulator according to claim 8, wherein the section (14) of the ribs (13) at an inlet side of an insertable component (10) that is placed after the first insertable component (9) has a rounded side facing the inlet, and that a rounded section at a discharge side thereof follows this directly.

11. A jet regulator according to claim 1, wherein a height of the support ring (12) of the insertable component (9, 10, 23) oriented in the direction of flow is larger than a height of the ribs (13), and that the ribs are located within a peripheral contour of the support ring (12).

12. A jet regulator according to claim 1, wherein at least two insertable components (9, 10, 23) are provided one after another in the direction of flow (Pf1), and are directly adjacent to one another.

13. A jet regulator according to claim 1, further comprising a jet splitting device installed before the jet regulation device (4) that has at least one perforated plate (3) that is removably attached to the jet regulator housing (2).

14. A jet regulator according to claim 13, wherein the perforated plate (3) pushes against one of the insertable components (9) at a discharge side thereof and that, to this end, the perforated plate (3) has guide stems or guide projections (18) on the discharge side that extend up to and contact the first insertable component (9).

15. A jet regulator according to claim 1, further comprising a flow rectifier (5) installed after the jet regulation device (4) at a discharge side, the rectifier having circular segmented or honeycomb shaped outlet openings (21) with opening widths that are smaller than a height thereof in the direction of flow.

16. A jet regulator according to claim 15, wherein the flow rectifier (5) is connected in one piece to the jet regulator housing (2) and is located at a discharge end thereof.

17. A jet regulator according to claim 15, wherein each adjacent opening (21) of the flow rectifier (5) has guide walls 22 that separate the adjacent openings and that extend approximately in the direction of flow (Pf1), the guide walls having a wall thickness that is a fraction of an unobstructed diameter of each of the openings (21) that is surrounded by the guide walls (22) and that the ratio h:D between the height (h) of the guide walls (22) and an overall diameter D of the flow rectifier (5) is less than 1.

18. A jet regulator according to claim 1, wherein the insertable components (23) are manufactured with the support ring (12) and the ribs (13) as a one-piece metal part via forging or cold forming.

19. A jet regulator according to claim 18, wherein the insertable components (23) are manufactured from metal sheet using a stamping and/or shaping process.

20. A jet regulator according to claim 18 , wherein at least one of the insertable components (23) that is provided as a stamped and/or shaped part is provided with the ribs (13) that have an external contour that widens in the flow direction.

21. A jet regulator according to claim 20, wherein the ribs (13) have a curved or roof-shaped external contour.

22. A jet regulator according to claim 21, wherein a tilt angle of the rib profile of the curved or roof-shaped ribs (13) provided on the insertable components (23) successively decreases in the direction of flow.

23. A jet regulator according to claim 19, wherein the metal sheet is made of brass or a stainless steel.

24. A jet regulator according to claim 19, wherein the projections (17) are formed from an un-deformed section of the metal sheet.

* * * * *